United States Patent [19]

Ragan

[11] 4,304,091

[45] Dec. 8, 1981

[54] APPARATUS FOR USING EXTERNAL DRIVE MOTORS FOR TWISTING AND WINDING STRAND MATERIAL ONTO A RECEIVER

[76] Inventor: Ralph L. Ragan, 82 Sheridan Dr., Atlanta, Ga. 30305

[21] Appl. No.: 75,179

[22] Filed: Sep. 12, 1979

[51] Int. Cl.[3] ..... D01H 1/26; D01H 1/00; D01H 7/02; D01H 7/24

[52] U.S. Cl. ..... 57/71; 57/66; 57/93; 57/100

[58] Field of Search ..... 57/66–71, 57/74, 92–94, 96, 100

[56] References Cited

U.S. PATENT DOCUMENTS

| | | | |
|---|---|---|---|
| 1,412,518 | 4/1922 | Guildford | 57/93 |
| 1,846,715 | 2/1932 | Gegauff | 57/96 |
| 2,026,155 | 12/1935 | Abbott | 57/93 |
| 2,485,776 | 10/1949 | Roberts | 57/71 X |
| 2,610,461 | 9/1952 | Ragan | 57/67 |
| 2,820,336 | 1/1958 | Sagehome | 57/71 X |
| 2,833,111 | 5/1958 | Hadlich | 57/74 |
| 2,985,994 | 5/1961 | Menke et al. | 57/93 X |
| 3,174,270 | 3/1965 | Blaschke | 57/67 |
| 3,926,072 | 12/1975 | Richardson | 57/71 X |
| 4,128,988 | 12/1978 | Ragan | 57/71 X |
| 4,196,572 | 4/1980 | Hunt | 57/96 |

*Primary Examiner*—John Petrakes

*Attorney, Agent, or Firm*—Lowe, King, Price & Becker

[57] ABSTRACT

An apparatus for twisting and winding strand onto a rotating bobbin comprises a spindle located within an open top pot both mounted for coincident rotation about a common axis. A strand guide mounted on the wall of the pot guides strand from an external source to be twisted and wound onto the bobbin. During rotation of the bobbin and pot, the pot is axially reciprocated relative to the bobbin to layer the strand while strand tension is monitored by a transducer located in the strand supply path. Strand tension is controlled by controlling the differential between the speeds of rotation of the bobbin and pot in response to the output of the transducer and a reference, as taught in my U.S. Pat. No. 4,128,988. In accordance with the present invention, the speed differential is developed by first and second external electric motors coupled respectively to the pot and bobbin to rotate the pot at a constant speed and the bobbin at a variable speed to impart a desired tension in the strand being wound onto the bobbin.

11 Claims, 1 Drawing Figure

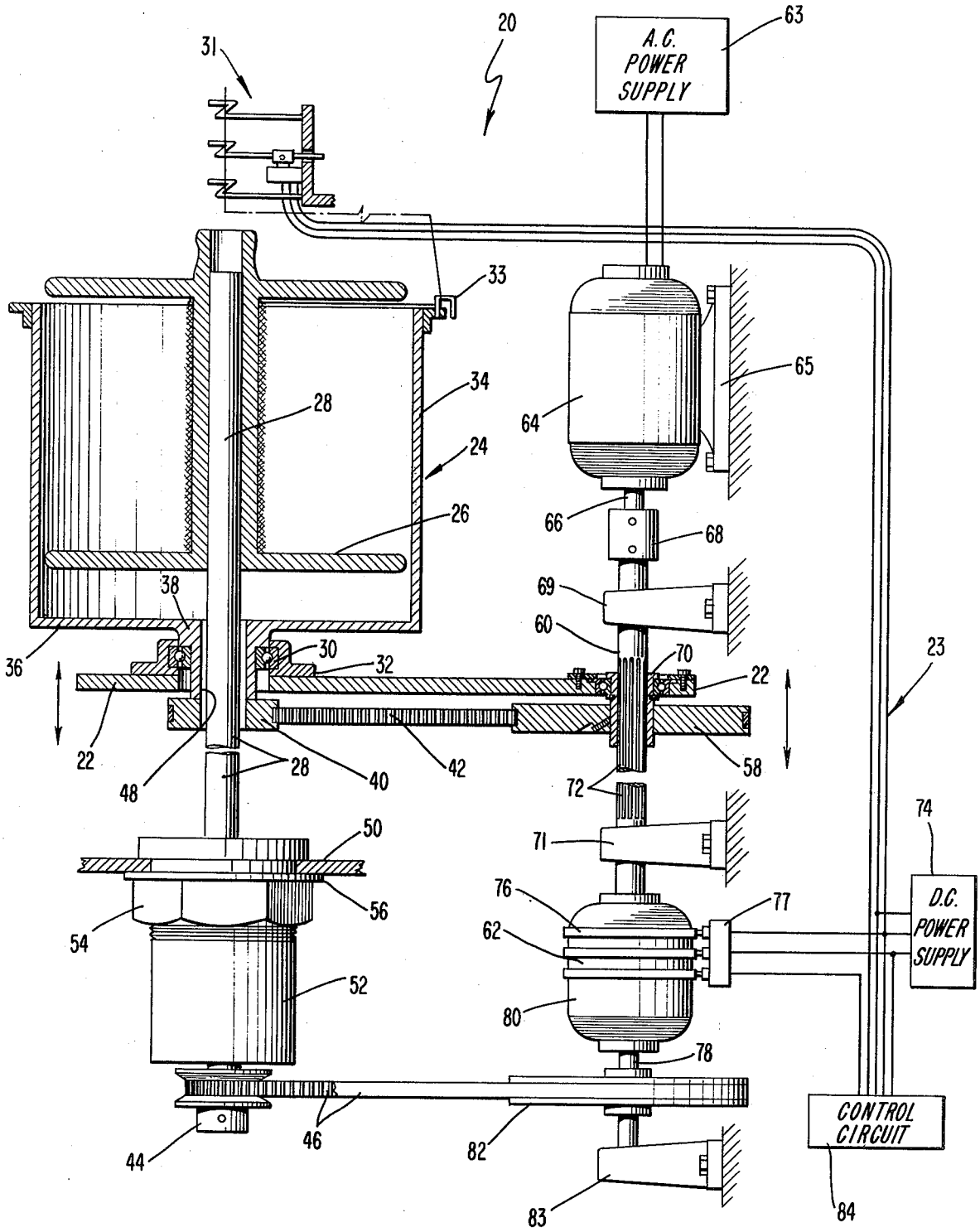
A.C. POWER SUPPLY
D.C. POWER SUPPLY
CONTROL CIRCUIT
20
23
22
24
26
28
30
31
32
33
34
36
38
40
42
44
46
48
50
52
54
56
58
60
62
63
64
65
66
68
69
70
71
72
74
76
77
78
80
82
83
84

APPARATUS FOR USING EXTERNAL DRIVE MOTORS FOR TWISTING AND WINDING STRAND MATERIAL ONTO A RECEIVER

BACKGROUND OF THE INVENTION

The present invention relates generally to an apparatus of the type described in my U.S. Pat. No. 4,128,988 for twisting and winding strand material, and more particularly, toward an improvement thereover wherein the strand guide and bobbin are coupled respectively to first and second external electric motors to control the strand tension.

In my U.S. Pat. No. 4,128,988, I describe an apparatus for twisting strand material drawn from an external supply while winding the strand onto a rotating bobbin. The bobbin is mounted on and keyed to rotate with a spindle along a common axis of rotation within an open top pot. The strand is guided onto the bobbin by a hook positioned on the wall of the pot, and during rotation of the pot and bobbin, the pot is axially reciprocated relative to the bobbin to cause layering of strand onto the bobbin body. Strand tension is controlled by controlling a differential between the speeds of rotation of the bobbin and pot in response to the difference between actual strand tension measured by a transducer in the strand supply path and a reference tension.

The spindle, which is journalled in a bolster, is rotated at a constant speed by an external motor coupled to the spindle through a timing belt. The open top pot and strand hook are keyed to the spindle for common rotation. The bobbin, on the other hand, is mounted on a sleeve around the spindle above a flat or "pancake" type electric motor having its stator connected to the pot and rotor coupled to rotate the sleeve and bobbin. Electric current is coupled to the pancake motor by slip rings provided on the outer surface of the pot wall to directly drive the motor and thereby establish the differential speed of rotation between the bobbin and the strand guide on the open top pot as a function of the measured and predetermined reference tensions.

While the provision of a pancake motor within the open top pot for directly establishing the rotational speed differential between the bobbin and strand guide is generally satisfactory and capable of providing excellent performance, it is in some applications preferable to rotate the bobbin and guide using larger external electric motors rather than an internal pancake motor, as in my patent. I have found that external drive motors will increase the versatility of the apparatus since an external drive configuration enables "off-the-shelf" motors having virtually any operating characteristics to be applied. Furthermore, the use of an external drive enables the configuration of the motor to be independent of the configuration of the pot whereby heavy duty applications, such as twisting tire cord, are possible.

OBJECTS OF THE INVENTION

Accordingly, a general object of the present invention is to provide a new and improved apparatus for twisting and winding strand onto a rotating bobbin.

Another object of the invention is to provide a new and improved apparatus for twisting and winding strand onto a rotating bobbin wherein external drive motors are used to rotate the bobbin and strand guide to provide improved versatility in motor selection and enable heavy duty twisting applications.

Another object of the invention is to provide a new and improved apparatus for twisting and winding strand onto a rotating bobbin, wherein first and second external electric motors are coupled to rotate the bobbin and strand guide and are controlled in response to the output of a tension transducer and reference source for establishing strand tension.

SUMMARY OF THE INVENTION

The apparatus of my invention comprises a spindle located within an open top pot along a common axis of rotation. The spindle is adapted to receive a bobbin that is keyed to rotate with the spindle, and a strand guide or hook is secured on the outer wall of the pot to guide strand from an external strand source to the bobbin. First and second external electric motors are coupled, respectively, to the pot and spindle to establish independent rotation. The pot is axially reciprocated relative to the bobbin during rotation to cause the strand to be located on the bobbin in layers.

Strand tension is controlled by controlling the differential between the speeds of rotation of the pot and bobbin. The magnitude of the differential speed of rotation is controlled by a strand tension control circuit that monitors the tension of strand being wound onto the bobbin, compares measured tension with a preset reference tension and generates an error signal to control the speed of rotation of the bobbin relative to the constant speed of rotation of the pot and strand guide.

The pot is coupled to the first motor, which is preferably a constant speed, AC induction motor, through a first timing belt, whereas the spindle is coupled to the second motor, which is preferably a variable speed DC motor, through a second timing belt and an in-line rotational speed reducer. The rotor of the constant speed induction motor is connected to the stator of the variable speed DC motor and the rotor of the DC motor in turn is coupled to the speed reducer having its output shaft coupled to the second timing belt.

A strand tension control signal generated by circuitry of a type shown in my U.S. Pat. No. 4,128,988, is supplied to the variable speed DC motor through a set of external slip rings. The signal controls the speed of rotation of the variable speed DC motor relative to the constant speed of rotation of the induction motor to cause the actual tension of the delivered strand to be approximately equal to the preselected reference tension.

The provision of external constant and variable speed electric motors for driving the bobbin and strand guide to establish the rotational speed differential therebetween, rather than the internal pancake motor shown in my U.S. Pat. No. 4,128,988, enables my apparatus for heavy duty winding applications and significantly improves versatility in selection of drive motors.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respect, all without departing from the invention. Accordingly, the drawing and description are to be regarded as illustrative in nature, and not as restrictive.

BRIEF DESCRIPTION OF THE DRAWING

The FIGURE is a schematic diagram showing the strand twisting and winding apparatus using first and second external electric drive motors, coupled to the strand guide and bobbin in accordance with the invention.

DETAILED DESCRIPTION OF A PREFERRED EMBODIMENT

Referring to the FIGURE, an apparatus 20 for twisting and winding strand onto a rotating bobbin, which is of a type similar to the apparatus shown in FIG. 6 of my U.S. Pat. No. 4,128,988, includes a horizontal support rail 22 supporting an open top pot 24 containing a strand receiver or bobbin 26 mounted on a spindle 28 with sufficient frictional engagement provided therebetween to insure co-rotation of said parts. The pot 24 is journalled on support rail 22 by ball bearing 30 within a collar 32. The rail 22 is mounted to a parent machine (not shown) containing a plurality of such pots 24.

The open top pot 24 includes a cylindrical side wall 34 and a circular base 36 formed to hub 38, and is adapted to rotate within bearing 30 independently of rotation of spindle 28. The spindle 28 in turn is journalled for rotation in a conventional bolster 52 mounted to the stationary horizontal platform 50 by nut 54 and washer 56. Spindle 28 extends vertically through the body of pot 34 through central bore 48 formed through the hub 38. A strand hook or guide 33 is fixed in the upper rim of the pot 24 to guide strand from an external supply (not shown) to the bobbin 26. During rotation of pot 24, the strand is twisted by guide 33 as it is wound onto the core of bobbin 26, as discussed in more detail in my patent.

A pulley 44 is attached to one end of spindle 28 below the bolster 52. Rotation is imparted to spindle 28 at the pulley 44 by a first timing belt 46 coupled to variable speed DC motor 62 through pulley 82, whereas independent rotation of pot 34 is provided by a second timing belt 42 extending between pulleys 40 and 58 and coupled to the constant speed motor 64. The pulley 58 is coupled to motor 64 through extender shaft 60 that is attached to the output shaft 66 of the motor by collar 68. The motor 64, which is preferably a substantially constant speed, AC induction motor, energized by AC supply 63, is vertically secured by mount 65 and positioned such that shaft 60 extends through ball bearing pillow blocks 69 and 71. A central portion of the shaft 60 is splined at 72 and engages splined bushing 61 which is fixedly mounted in a central bore through pulley 58 that is journalled within rail 22 by ball bearing 70. Rail 22, together with all elements mounted thereto, is reciprocated vertically during layering of the strand onto the bobbin 26.

Shaft 60 is also secured to the stator housing of motor 62, which preferably is a variable speed, DC motor receiving energization from DC power supply 74 through slip rings 76 disposed circumferentially along the outer surface of the motor housing. The output of motor 62 is supplied to shaft 78 through a conventional in-line speed reducer 80. Secured to the output shaft 78 of reducer 80 above ball bearing pillow block 83 is the pulley 82 which couples to the second timing belt 46 fo rotating spindle 28.

Strand tension is measured by tension transducer 31 within the strand supply path. The transducer 31 has a resistance that is varied as a function of strand tension in a manner described in my U.S. Pat. No. 4,128,988, incorporated herein by reference in its entirety. The output of transducer 31 is applied to control circuit 84 over lines 73 which generates a driving current to DC motor 62 through slip rings 76 and contacts 77 in a manner also described in detail in my patent.

Thus, whereas pot 24 and strand guide 33 are rotated at a constant speed by induction motor 64, while the pot and guide are vertically reciprocated by rail 22 to cause twisting and layering of strand onto the bobbin 26, the bobbin and spindle 28 are rotated at a variable speed in response to control circuit 84 to wind the strand onto the bobbin 26 with a predetermined strand tension. The significance of the external bobbin and strand guide drive configuration shown in the FIGURE is that an internal pancake motor is not required, allowing for the possibility of heavy duty strand-winding applications and that virtually any types of motors can be used for driving the bobbin and guide for significantly increased versatility.

Considering now operation of apparatus 20 in more detail, the following exemplary structural and operational parameters will be assumed: motor 64 is a 3,600 r.p.m., constant speed induction motor; the pulley ratio of pulleys 40, 58 is 5:1; the pulley ratio of pulleys 44, 82 is 1:5; motor 62 is a variable speed DC motor; and the pot 34 is rated to rotate at 18,000 r.p.m. (3,600 r.p.m.×5). The gear ratio of reducer 80 depends upon the operating speed of DC motor 62 in response to applied voltage and pot-bobbin rotational speed differential.

Assuming also a desired strand twist of 10 turns/inch, the lineal feed rate based on a pot speed of 18,000 r.p.m. is 1,800 inches/minute. Further assuming that a 1½ inch diameter bobbin (empty) fills to a 5 inch diameter strand layer, then to receive a strand delivery rate of 1,800 inches/minute, the bobbin 26 must rotate relative to pot 24 at a winding speed of 382 r.p.m. (empty) and decrease to a minimum relative rotational speed (winding speed) of 115 r.p.m. as the bobbin fills. Since the rated speed of AC motor 64 is 3,600 r.p.m. and a 5:1 speed-up ratio is provided between pulleys 58 and 40 to obtain the 18,000 r.p.m. pot speed, the output shaft 78 of speed reducer 80 varies from 3,524 r.p.m. at empty bobbin to 3,577 r.p.m. at full bobbin. The bobbin speed of rotation increases from a minimum speed of 17,618 r.p.m. (18,000 r.p.m. pot speed—382 r.p.m. winding speed) to a maximum speed of 17,885 r.p.m. (18,000 r.p.m. pot speed—115 r.p.m. winding speed).

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

For example, it should be apparent that any suitable types of motors may be used as motors 62 and 64 in addition to the ones shown and described. Further, it is to be understood that particular pulley rates and operating speeds have been shown for purpose of illustration and would be different for different operating specifications.

What I claim is:

1. An apparatus for twisting and winding strand by feeding the strand substantially axially onto a rotating strand receiver, comprising a spindle, said receiver being removably secured to and adapted to rotate with said spindle;

strand guide means for guiding said strand onto said receiver;

first motor means for rotating said strand guide means;

second motor means directly mechanically coupled to and rotated by said first motor means for rotating said spindle and said receiver concentrically to said strand guide means, said spindle and said guide means being rotatable at different speeds relative to each other;

means for imparting axial relative movement between said guide means and said receiver during rotation of said receiver;

means for measuring tension of the strand being wound onto said receiver; and means responsive to strand tension for controlling a differential between the speeds of rotation of said guide means and said receiver.

2. The apparatus of claim 1, wherein said receiver comprises a bobbin mounted within an open top pot, said spindle extending along an axis of rotation of said pot, said guide means being mounted on a wall of said pot.

3. The apparatus of claim 1, including first belt means for coupling said first motor means with said strand guide and second belt means for coupling said second motor means with said spindle.

4. The apparatus of claim 1, wherein said controlling means includes feedback circuit means responsive to said tension measuring means for controlling speed of rotation of said second motor means.

5. The apparatus of claim 4, including speed reduction means between said second motor means and said second belt means.

6. The apparatus of claim 5, wherein said first motor means is a constant speed motor.

7. The apparatus of claim 6, wherein said first motor means includes a rotor that is connected to a stator of said second motor means, said second belt means being coupled to an output shaft of said speed reducing means.

8. A twisting and winding apparatus, comprising:

a spindle;

an open ended pot having a base and a cylindrical sidewall, said spindle extending through an axis of rotation of said base and journalled thereto for relative rotation;

a bobbin removably mounted on said spindle and extending into said pot, said bobbin being in frictional engagement for rotation with said spindle relative to said pot;

hook means mounted on the sidewall of said pot for guiding a strand substantially axially onto said bobbin;

means for imparting axial relative movement between said hook means and said bobbin;

first motor means for rotating said pot at a constant speed of rotation;

second motor means directly mechanically coupled to and rotated by said first motor means for rotating said spindle at a variable speed of rotation;

said first and second motor means being external to said pot;

means for monitoring strand tension; and means for controlling the speed of said second motor means relative to said first motor means in response to said monitoring means.

9. The apparatus of claim 8, including first coupling means for coupling said first external motor means and said pot and second coupling means for coupling said second external motor means and said spindle.

10. The apparatus of claim 9, wherein said first and second coupling means includes, respectively, first and second timing belts.

11. An apparatus for twisting and winding strand by feeding the strand substantially axially onto a rotating strand receiver, comprising:

a spindle;

means for removably securing said receiver to said spindle;

an open top pot containing on its axis of rotation said spindle and said receiver, said spindle and said pot being rotatable relative to each other;

strand hook means located on a wall of said pot for guiding strand onto said receiver;

first constant speed motor means external to said pot for rotating said pot;

second variable speed motor means directly mechanically coupled to and driven by said first motor means for rotating said spindle and said receiver;

means for imparting axial relative movement between said hook means and said receiver during rotation of the receiver;

means for monitoring tension of the strand being wound onto said receiver; and means responsive to strand tension for controlling the speed of rotation of said second variable speed motor relative to said constant speed motor.

* * * * *